US005161585A

United States Patent [19]

Murao et al.

[11] Patent Number: 5,161,585

[45] Date of Patent: Nov. 10, 1992

[54] LIQUID FILLING APPARATUS HAVING A BIASED GAS PIPE MOUNTED FOR A SMALL RANGE OF MOVEMENT

[75] Inventors: Kazunori Murao; Yukio Yamaguchi; Tutomu Oohashi, all of Nagoya, Japan

[73] Assignees: Mitsubishi Jukogyo Kabushiki Kaisha, Tokyo; Churyo Engineering Kabushiki Kaisha, Aichi, both of Japan

[21] Appl. No.: 687,407

[22] Filed: Apr. 18, 1991

[30] Foreign Application Priority Data

Apr. 19, 1990 [JP] Japan ..... 2-41080[U]
Apr. 26, 1990 [JP] Japan ..... 2-43988[U]
May 14, 1990 [JP] Japan ..... 2-49059[U]

[51] Int. Cl.[5] ..... B67C 3/06; B65B 31/00

[52] U.S. Cl. ..... 141/39; 141/288; 141/DIG. 1; 141/145; 141/165; 141/89; 141/266

[58] Field of Search ..... 141/39, 40.6, 198, 147, 141/146, 165, 177, 288, 89, 90, 91, DIG. 1, 275, 266, 368, 372

[56] References Cited

U.S. PATENT DOCUMENTS 2,770,263 11/1956 Breeback ..... 141/6
3,889,725 6/1975 Rademacher et al. ..... 141/5
4,688,608 8/1987 Puskarz et al. ..... 141/39
4,798,234 1/1989 Dugan ..... 141/165
4,938,261 7/1990 Petri et al. ..... 141/39
5,065,799 11/1991 Weiss ..... 141/39

FOREIGN PATENT DOCUMENTS 2-242783 9/1990 Japan .

*Primary Examiner*—Ernest G. Cusick
*Attorney, Agent, or Firm*—Wenderoth, Lind & Ponack

[57] ABSTRACT

The known liquid filling apparatus of the type including a housing, an annular liquid feed passageway, a liquid valve, a holding member and a gas pipe, is improved so as to facilitate cleaning of the interior of the apparatus, so as to be applicable to a container having a small mouth diameter, and so as to facilitate replacement of a gas pipe. The improvement resides in that, on the inner circumferential side of the holding member disposed slidably along the housing, are disposed a circular ring provided slidably along the same inner circumferential surface and a spring for normally biasing the circular ring in the downward direction. A desired gap space is provided between a lower surface of the circular ring and an upper surface of a positioning conical cylinder having a sealing element for the mouth edge portion of a container to be filled with liquid by fixing a bend member fitted around the outer circumferential surface of the gas pipe to the circular ring and fixing the positioning conical cylinder to the holding member.

7 Claims, 6 Drawing Sheets

LIQUID FILLING APPARATUS HAVING A BIASED GAS PIPE MOUNTED FOR A SMALL RANGE OF MOVEMENT

BACKGROUND OF THE INVENTION

1. Field of the Invention

The present invention relates in general to a filling apparatus, and more particularly to a liquid filling apparatus applicable to a canning machine or the like.

2. Description of the Prior Art

At first, a filling machine in the prior art, which is disclosed in Japanese Patent Application No. 1-55185 (1989), will be described with reference to FIG. 9. In this figure, gas switching valve main bodies 953 are fixedly secured at predetermined intervals to a bottom of an annular tank 932 for accommodating liquid by means of bolts 954, and on the bottom surface of the gas switching valve main body 953 is a housing 901 fixedly secured to the former by means of bolts 955. Liquid to fill a container 934 is subjected to gas pressure while occupying an inner space 933 of the aforementioned annular tank 932. The surface of the liquid is held lower than the upper level of the available inner space 933 of the annular tank 932 so that a space for gas extends above the surface. On the outside of the housing 901 is slidably mounted a holding cylinder 904 which is formed as a hollow cylinder and serves to position and seal a container 934. The holding member 904 is held in tight contact with the outer surface of the housing 901 at a location indicated by reference numeral 935, and on its central side surface portion, it has a recess 936 which is adapted to receive a fork-shaped tool (not shown) for vertically moving this holding member 904 with respect to the housing 901. The holding member 904 is provided with a positioning conical portion 937 defining a tapered opening extending inwardly from its bottom end. At the inner end portion of this positioning conical portion 937 is disposed a sealing element 938 serving as a seal member for the container 934.

The container 934 is placed on a lower support table 939 fixed to the housing 901, and it is constrained at a position centered with respect to the filling apparatus by means of a semi-circular guide section 940.

The housing 901 has an inner piece 941 at its interior, and between the inner piece 941 and an outer portion of the housing 901 is formed a nearly annular liquid feed passageway 942. An injection port 926 is provided at the bottom of the liquid feed passageway 942, and a liquid jet flow is led from the injection port 926 to an inner wall surface of the container 934, where the liquid flows toward the bottom of the container in as much of a laminar flow as is possible. The housing 901 has a stepped portion 943 defined on its inside surface, and this also defines an upper end of the inner piece 941.

The liquid feed passageway 942 terminates here, and since this passageway must be sealed here, an annular liquid valve 944 is disposed above this stepped portion 943, and this annular liquid valve 944 can be vertically moved by a pipe 946.

On the outside of the upper portion of the pipe 946 is disposed a compression spring (not shown). An inner space and an outer space 950 defined inwardly and outwardly of the pipe 946, respectively, communicate with the inner space 933 of the annular tank 932 via holes 945. On the inside of the inner piece 941 is disposed a gas pipe 951. A stepped portion 951*a* is provided at the top end portion of the gas pipe 951, a flange 951*b* is provided at a lower portion thereof, and a stopper piece 970 is fixed by a retaining ring 971 on the inside of the inner piece 941 proximate the center thereof to serve as a positioning member for the gas pipe 951. On the other hand, on the outside of the gas pipe 951 is disposed a spring 972. The bottom end of the spring 972 is fitted and secured to the upper surface of the flange 951*b* of the gas pipe 951, its top end butts against the stopper piece 970, and thus the spring 972 normally biases the gas pipe 951 in the downward direction.

A free end portion 986 of a bend member 985 is fitted around the gas pipe 951 without being fixedly secured thereto. The bend member 985 has one arm 989 connected to the holding member 904 by means of a pin 925 and a nut 924.

An upper surface 987 of the free end portion 986 of the bend member 985 and a lower surface of the gas pipe flange 951*b* are disposed with a predetermined gap S maintained therebetween.

The gas pipe 951 extends to the space 957 within the gas passageway 956, and this gas passageway extends upwards to the gas space in the annular tank 932 defined above of the liquid surface, whereby the inside of the gas pipe 951 communicates with the gas space defined within the annular tank 932. Within the gas passageway 956 is disposed a gas valve (not shown). Between the outer surface of the housing 901 and the inner surface of the holding member 904 is provided an annular chamber 959. This annular chamber 959 communicates via a passageway 962 with a release valve 961 which can be opened externally by means of a tappet 960, and the annular chamber 959 communicates via a passageway 963 with the interior of the sealing element 938.

The above-described filling apparatus in the prior art gives rise to the following problems.

That is, since the spring 972 for biasing the gas pipe 951 downwards is provided between the flange 951 at the lower portion of the gas pipe and the stopper piece 970 fixedly secured to the housing inner piece 941, when the container 934 is taken out from the filling apparatus, a compression length of the above-mentioned spring 972 at the time of raising the holding member 901 upwards and elevating the lower surface of the above-described gas pipe 951 up to a desired level with respect to the edge of the open end of the container 934, would correspond to a "stroke-S" of raising the aforementioned holding member. For instance, a compression length of 20–25 mm would become necessary. While a spring usable over such a large compression stroke can be manufactured in the case of a large opening diameter of a container because the inner diameter of the housing inner piece 941 is large, in the case of a filling apparatus for a container having a small opening diameter, a spring usable over the above-described large compression stroke would be impossible to manufacture.

Also, in the above-described filling apparatus in the prior art, the stepped portion 951*a* of the gas pipe 951 is restrained from moving downwards by the stopped piece 970 and the retaining ring 971 on the inside portion of the inner piece 941. Consequently, when the gas pipe 951 is to be replaced, the retaining ring 971 must be removed by inserting a special tool into a narrow space between the inside portion of the inner piece 941 and the outer circumference of the spring 972. This work takes a lot of time.

SUMMARY OF THE INVENTION

It is therefore one object of the present invention to provide an improved filling apparatus in which the aforementioned problems in the prior art can be resolved.

According to one feature of the present invention, a gas pipe of a filling apparatus which determines a filled volume within a container is slidably fitted into an inner piece of a housing, and a step portion for positioning the gas pipe in the downward direction is provided at an injection port. In addition, there are provided a circular ring slidably fitted on the inner circumference of a holding member and a spring for normally biasing the circular ring in the downward direction. Positioning in the downward direction is carried out by causing a flange at the middle portion of the gas pipe to butt against the stepped portion provided at the injection port. A free end of a bend member fixedly secured to the above-mentioned gas pipe are unslidably fitted to each other. A desired gas space is provided between the bottom of the circular ring and a top surface of a conical cylinder.

Owing to the above-mentioned provision, the large stroke generated upon raising the holding member when a container is removed from the filling apparatus is not propagated to the aforementioned spring.

Also, according to another feature of the present invention, a gas pipe for determining a filled amount within a container is slidably fitted in a housing inner piece fixedly secured to a housing in a coaxial manner. At a middle portion of the gas pipe is provided a flange, and at the bottom portion of the housing inner piece is provided a step portion adapted to be engaged with the flange at the middle portion of the gas pipe for positioning the gas pipe.

A free end portion of a bend member fixedly secured to a holding member, which is vertically slidable along the outer circumference of a housing, is slidably fitted around the gas pipe under the flange at the middle portion of the gas pipe. A spring for normally biasing the gas pipe downwards is provided on the lower surface of the free end of the bend member. A desired gap space is provided between the upper surface of the free end portion of the bend member and the opposed flange at the middle portion of the gas pipe.

In addition, in a filling apparatus according to the present invention, a plate-shaped flange having a longer diameter and a shorter diameter along two orthogonal directions is provided at a middle portion of a gas pipe. At a portion fixed to a housing (for instance, an inner circumferential portion of an injection port) is provided a step having a slot-like opening whose width is narrower than the length of the gas pipe longer diameter flange of the gas pipe middle flange and broader than the width of the longer diameter flange. At the portion of the outer circumferential surface of the gas pipe under the above-described gas pipe middle flange is provided a guide surface along the axial direction of the pipe in the direction of the gas pipe longer diameter flange. The free end portion of the bend member fixedly secured to the holding member is slidably fitted to the guide surface provided at the lower portion of the gas pipe.

Owing to the above-described structural features, the present invention can offer the following effects and advantages:

(1) Since the gas pipe and the free end portion of the bend member fixed to the circular ring are fixedly secured to each other, as by screws, recesses or the like, and the gas pipe is positioned by the step portion with respect to the injection port, if the height of the annular tank for filling a container is changed, then the depth from the lower surface of the gas pipe to the upper surface of the container can be arbitrarily changed.

(2) If the height of the annular tank is changed, then the holding member and the sealing element provided on the positioning conical cylinder can slide along the housing while compressing a spring without changing the depth from the lower surface of the gas pipe and the upper surface of the container, because the circular ring and the fixed end of the bend member as well as the free end of the bend member and the gas pipe are integrally secured to each other, and the above-mentioned sealing element and the upper surface of the container can butt against each other.

(3) When the filling step of the process terminates and the holding member, sealing element and positioning conical cylinder begin to be raised integrally and simultaneously from the upper surface of the container, the gap distance between the upper surface of the positioning conical cylinder and the lower portion of the circular ring is narrowed while the spring for biasing the circular ring downwards is being stretched. Eventually the upper surface of the positioning conical cylinder and the lower portion of the circular ring butt against each other, and the gas pipe is raised higher than the upper surface of the container since it is integrally joined with the bend member circular ring.

Furthermore, according to the present invention, if the holding member is raised when a container is removed from the filling apparatus, at the point in time when the gap distance between the upper surface of the free end portion of the bend member fixed to the holding member and the flange at the middle portion of the gas pipe has become zero, the bend member pushes up the gas pipe. Accordingly, the large stroke generated when the holding member is raised would not propagate to the aforementioned spring.

Still further according to the present invention, the gas pipe is inhibited from rotation by the bend member being fixedly secured to the holding member and the phase relationship between the longer diameter flange portion of the gas pipe and the slot-like opening provided at the inner circumferential portion of the injection port. Therefore, prevention of the gas pipe from downwardly slipping out can be insured. On the other hand, in the case of replacing the gas pipe, if the holding cylinder is extracted downwards, then the fitting between the gas pipe and the bend member is released. Thus if the gas pipe is manually turned by 90½, the gas pipe can be easily removed without employing a tool, because the position of the longer diameter flange portion of the gas pipe changes to the lengthwise direction of the U-shaped opening at the inner circumferential portion of the injection port.

The above-mentioned and other objects, features and advantages of the present invention will become more apparent by reference to the following description of preferred embodiments of the invention taken in conjunction with the accompanying drawings.

BRIEF DESCRIPTION OF THE DRAWINGS

In the accompanying drawings:

FIG. 2(*b*) is a cross-sectional view of part of a gas pipe and a bend member in the second preferred embodiment in an enlarged scale;

DETAILED DESCRIPTION OF THE PREFERRED EMBODIMENTS

Figure 1:
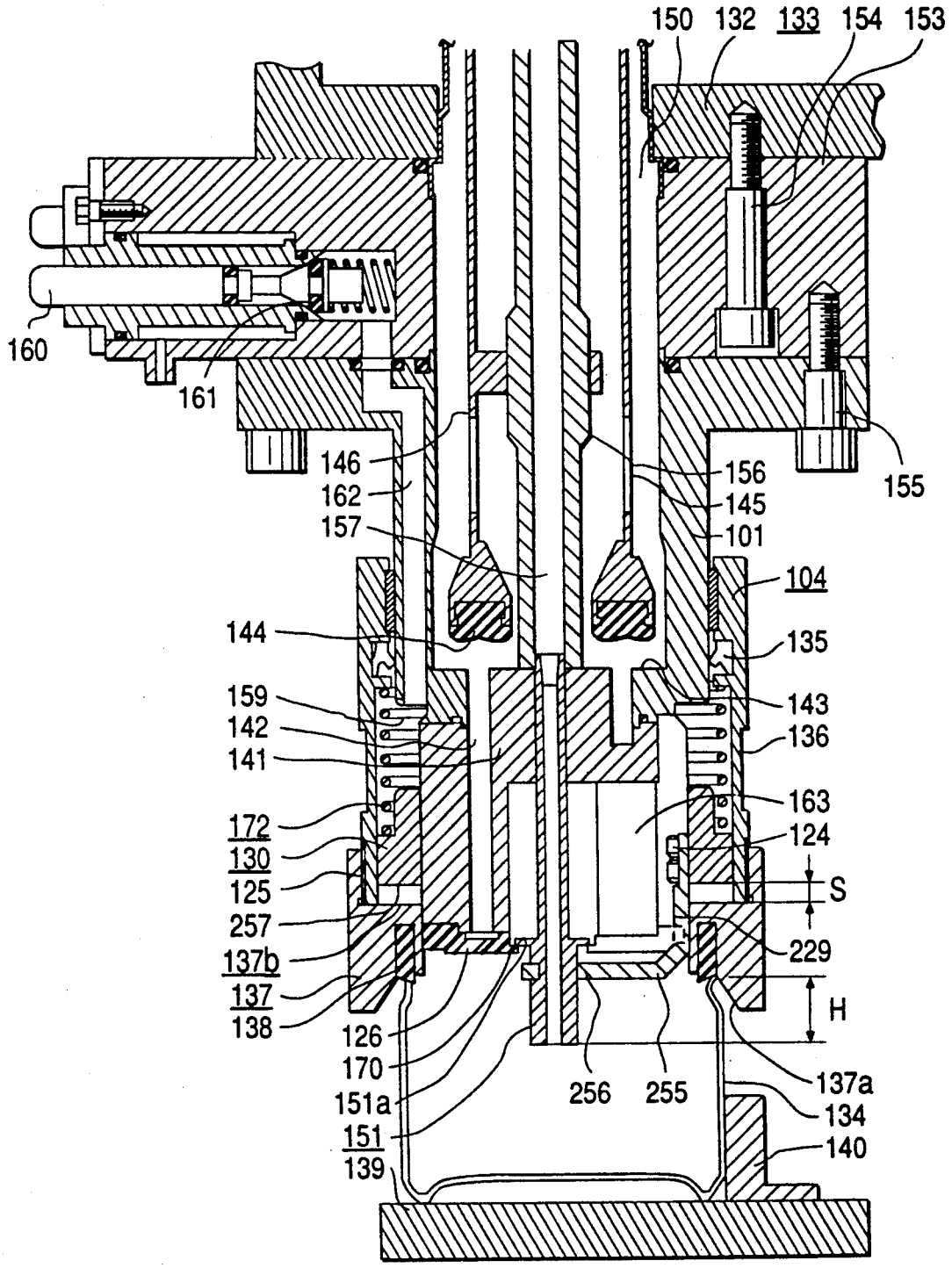
FIG. 1 is a vertical cross-sectional view of a first preferred embodiment of the present invention.

Now, a first preferred embodiment of the present invention will be described in detail with reference to FIG. 1. In this figure, gas switching valve main bodies 153 are fixedly secured at predetermined intervals to a bottom of an annular tank 132 for accommodating liquid, by means of bolts 154. On the bottom surface of the gas switching valve main body 153 is a housing 101 fixedly secured to the former by means of bolts 155. Liquid to fill a container 134 is subjected to a gas pressure while occupying an inner space 133 of the aforementioned annular tank 132. The surface of the liquid is made lower than the upper level of the available inner space 133 of the annular tank 132 so that a space for gas extends above the surface. On the outerside of the housing 101 are slidably mounted a holding member 104 and a positioning conical cylinder 137 which are formed as hollow cylinders and serve to position and seal the container 134. The holding cylinder 104 and the positioning conical cylinder 137 are connected at a threaded portion 125. On the inside of these members is slidably assembled a circular ring 130. A resilient force of a spring 172 is exerted downwardly on the ring 30.

The holding member 104 is held in tight contact with an outer surface of the housing 101 at the location indicated by reference numeral 135, and it has a recessed portion 136 at its central portion engageable with a fork-shaped tool (not shown) for vertically moving this holding member 104 with respect to the housing 101. The positioning conical cylinder 137 has a positioning conical portion 137*a* defining a tapered opening extending inwardly from its bottom end. At the inner end portion of this positioning conical portion 137*a* is disposed a sealing element 138 serving as a seal member for the container 134.

The container 134 is placed on a lower support table 139 fixed to the housing 101, and it is constrained at a position centered with respect to the filling apparatus by means of a semi-circular guide section 140.

The housing 101 has an inner piece 141 at its interior, and between the inner piece 141 and an outer portion of the housing 101 is formed a nearly annular liquid feed passageway 142. An injection port 126 is provided at the bottom of the liquid feed passageway 142, and a liquid jet flow is led from the injection port 126 to an inner wall surface of the container 134, where the liquid flows toward the bottom of the container while forming as much as is possible a laminar flow. The housing 101 has a stepped portion 143 defined on its inside surface, and this also defines an upper end of the inner piece 141.

The liquid feed passageway 142 terminates here, and since this passageway must be sealed here, an annular liquid valve 144 is disposed above this stepped portion 143, and this annular liquid valve 144 can be vertically moved by a pipe 146.

On the outside of the upper portion of the pipe 146 is disposed a compression spring (not shown). An inner space and an outer space 150 defined inwardly and outwardly of the pipe 146, respectively, communicate with the inner space 133 of the annular tank 132 via holes 145. On the inside of the inner piece 141 is disposed a gas pipe 151. A flange 151*a* is provided on the gas pipe 151 and a stepped portion 170 is provided on an inside portion in the proximity of the center of the injection port 126, and these serve to position the gas pipe 151 in the downward direction.

A free end portion 256 of a bend member 255 is fixedly secured to the outer circumference of the gas pipe 151. The bend member 255 has another arm 229 thereof connected to an annular ring 130 by means of bolts 124. A bottom 257 of the annular ring 130 and a top surface 137*b* of the positioning conical cylinder 137 are disposed so as to maintain a predetermined gap space S therebetween.

The gas pipe 151 reaches an inner space 157 of a gas passageway 156. The gas passageway 156 extends upward to the inside of gas space in the annular tank 132 and terminates above the liquid surface, whereby the inside of the gas pipe 151 communicates with the inner gas space of the annular tank 132. Within the gas passageway 156 is disposed a gas valve (not shown). Between the outer surface of the housing 101 and the inner surface of the holding member 104 is provided an annular chamber 159. The annular chamber 159 communicates, via a passageway 162, with a release valve 161 which can be opened externally by means of a tappet 160. The annular chamber 159 also communicates, via a passageway 163, with the space inside of the sealing element 138.

The above-described filling apparatus operates in the following manner. That is, an empty container 134 having its mouth opened is carried in by a conveying device (not shown). The container 134 is transported onto the lower support table 139, and is centered with respect to the filling apparatus by means of the guide section 140. By means of a fork-shaped tool (not shown) that is engageable with the recessed portion 136 of the above-described holding member 104, the holding member 104 and the positioning conical cylinder 137 are moved downward and seat on the container 134. A gas valve (not shown) within the gas passageway 156 is opened by a control device (not shown), and thus gas is fed from the inner space 133 of the annular tank 132 through the gas passageway 156 and the gas pipe 151 to the inside of the container 134, the inside of the liquid feed passageway 142, the inside of the passageways 162 and 163, and the inside of the chamber 159. Since all these areas are communicated with one another, they attain an equal pressure. After pressure equilibrium has been attained, an annular liquid valve 144 opens automatically under the action of a spring. As a result, liquid pours into the container through the liquid feed passageway 142 and the injection port 126, and the container 134 is filled until the liquid surface reaches the mouth of the gas pipe 151.

Since the other valves are closed, when the liquid in the container 134 reaches the mouth of the gas pipe 151 at its lower surface, gas existing at the upper portion of the container cannot escape, and further filling of liquid becomes impossible. Therefore, the amount filled in the container 134 is determined by the depth H of the lower surface of the gas pipe 151 as measured from the upper edge of the container 134 abutting the sealing element 138. In adjusting the amount filled, depending upon the kind of liquid or size of container, the depth H can be varied by only setting the annular tank 132 differently with respect to the lower support table 139 by a vertical movement means (not shown).

Thereafter, the annular liquid valve 144 and a gas valve (not shown) in the gas passageway 156 are mechanically closed by a control device (not shown), and the inner space of the container is sealed shut from the inner space of the annular tank 132 and the atmospheric air.

Subsequently, the release valve 161 is opened as a result of actuation of the tappet 160 by means of a cam (not shown), and the pressure in the inner space of the container 134 is released through the passageway 163, the chamber 159, the passageway 162 and the release valve 161.

After pressure release has been carried out, the holding member 104, the positioning conical cylinder 137 and the sealing element 138 are integrally and simultaneously raised from the upper surface of the container by means of an elevator device (not shown). Then the gap space S between the lower surface 257 of the circular ring 130, subjected to a downward force of the spring 172, and the upper surface 137*b* of the positioning conical cylinder 137 is gradually narrowed, and eventually the surfaces would butt against each other. Subsequently the gas pipe 151 is raised up from the upper surface of the container integrally with the holding member 104 and the positioning conical cylinder 137 and simultaneously with the bend member 255 and the circular ring 130.

Subseqently the container 134 is transferred from a rotary zone of a filling machine to a rotary zone of a sealing machine (not shown).

Figure 2A:
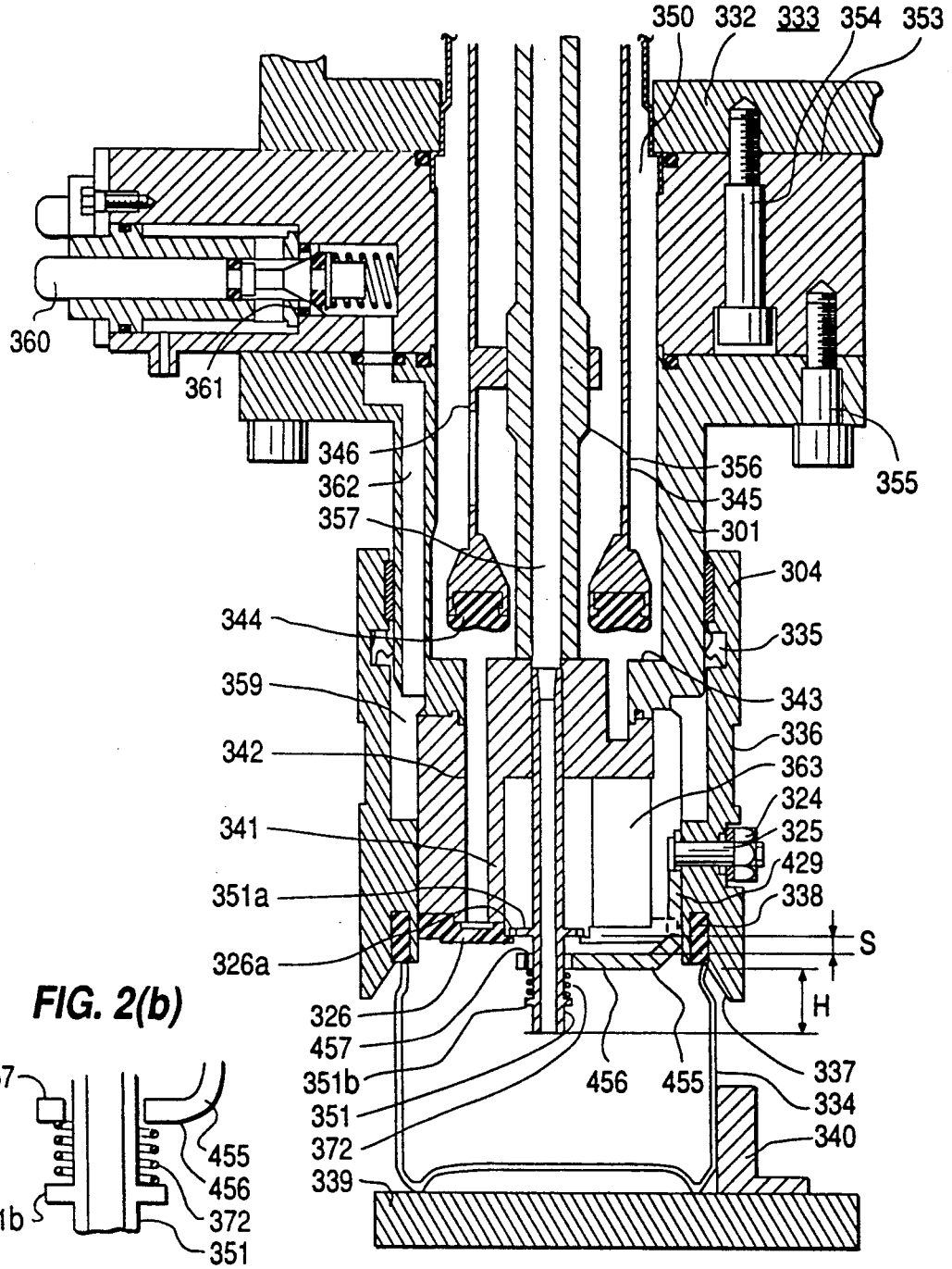
FIG. 2(*a*) is a vertical cross-sectional view of a second preferred embodiment of the present invention.
Figure 2B:
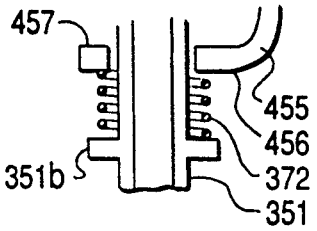

Next, a second preferred embodiment of the present invention will be described with reference to FIG. 2. In this figure, gas switching valve main bodies 353 are fixedly secured at predetermined intervals to the bottom of an annular tank 322 for accommodating liquid by means of bolts 354. On the bottom surface of the gas switching valve main body 353 is a housing 301, fixedly secured by means of bolts 355. Liquid to be filled in a container 334 is subjected to a gas pressure while being accommodated within an inner space 333 of the above-mentioned annular tank 322. The surface of the liquid is made lower than the height of the free inner space 333 of the annular tank 332 so that a gas space extends above the surface. On the outside of the housing 301 is slidably mounted holding cylinder 304, formed as a hollow cylinder and serving to position and seal the container 334.

The holding cylinder 304 is held in tight contact with the outer surface of the housing 301 at the location indicated by reference numeral 335. The holding cylinder 304 has a recessed portion 336 engageable with a fork-shaped tool (not shown) for vertically moving the holding cylinder 304 with respect to the housing 301 on the side surface of the central portion of the housing 301. The holding cylinder 304 has a positioning conical portion 337 formed as a tapered surface extending inwardly from its bottom. At the inner top end portion of the positioning conical portion 337 is disposed a sealing element 338 serving as a seal member for the container 334.

The container 334 is placed on a lower support table 339 fixed to the housing 301, and is constrained at a position centered with respect to the filling apparatus by means of a semi-circular guide section 340.

The housing 301 has an inner piece 341. Between the inner piece 341 and the housing 301 is formed a liquid feed passageway 342 of a nearly annular shape. An injection port 326 is provided at the bottom of the liquid feed passageway 342, and a liquid jet flow is led from the injection port 326 to an inner wall surface of the container 334, where the liquid flows towards the bottom of the container 334 while forming a laminar flow as much as is possible. The housing 301 has an inner step portion 343, and this also forms an upper limit of the inner piece 341.

The liquid feed passageway 342 terminates at the step portion 343, and since this passageway must be sealed at this point, an annular liquid valve 344 is disposed above the step portion 343. The annular liquid valve 344 can be moved vertically by a pipe 346.

On the outside of an upper portion of the pipe 346 is disposed a compression spring (not shown). An inner space and an outer space 350 of the pipe 346 communicate with the inside 333 of the liquid space of the annular tank 332 via holes 345. On the inside of the inner piece 341 is disposed a gas pipe 351. A gas pipe middle flange 351*a* is provided at the middle portion of the gas pipe, while at the lower portion is provided a gas pipe lower flange 351*b*. A step portion 326*a* is provided at an inner circumferential portion of the injection port 326, which is fixedly secured to the housing 301 as well as the above-mentioned inner piece 341. The step portion 326*a* serves to position the gas pipe 351 in the downward direction. On the outside of the gas pipe 351, under the middle flange 351*a*, is disposed a spring 372. The bottom end of the spring 372 is fitted and secured to an upper surface of the gas pipe lower flange 351*b*, while the top end thereof butts against a lower surface of a free end portion 456 of a bend member 455 fixedly secured to the above-mentioned holding cylinder 304. The gas pipe 351 is normally biased downwards against the injection port 326 fixedly secured to the housing 301.

A free end portion 456 of the bend member 455 slidably fits around the outer circumference of the gas pipe 351 under the middle flange. The bend member 455 has another arm 429 thereof connected to the holding cylinder 304 by means of a pin 325 and a nut 324. When the sealing element 338 butts against the upper edge of the container 334, after the gas pipe 351 has been stopped at a fixed position, with its middle flange 351*a* butting against the step portion 326*a* of the inner circumferential portion of the injection port, the free end portion of the above-mentioned bend member 455 further descends while compressing the spring 372. A gap space S is thus produced between the lower surface of the gas pipe middle flange 351*a* and the upper surface 457 of the free end portion 456 of the bend member 455. Also, sealing between the filling apparatus and the upper edge of the container becomes possible.

The gas pipe 351 extends into the inner space 357 of the gas passageway 356. The gas passageway 356 extends upward to the inside of the gas space of the annular tank 332 and terminates above the liquid surface, whereby the inside of the gas pipe 351 communicates with the inside of the annular tank 332.

Within the gas passageway 356 is disposed a gas valve (not shown). Between the outer surface of the housing 301 and the inner surface of the holding member 304 is provided an annular chamber 359. The chamber 359 communicates via a passageway 362 with a release valve 361, which can be externally opened by means of a tappet 360. The annular chamber 359 is connected via a passageway 363 to an inner space of the sealing element 338. An empty container 334 having its mouth opened is fed by a conveying device (not shown) onto the lower support table 339 and is centered with respect to the filling apparatus by means of the guide section 340.

The above-described holding cylinder 304 is moved downwards by a fork-shaped tool (not shown) which engages a recessed portion 336 of the holding cylinder 304. The holding cylinder 304 then seats on the container 334. The gas valve (not shown) within the gas passageway 356 is opened by a control device not shown, and gas flows through the gas passageway 356 and the gas pipe 351 to the inside of the container 334 from the inner space 333 of the inner tank 332. Because the inside of the liquid feed passageway 342, the insides of the passageways 362 and 363, and the inside of the chamber 359 all communicate with one another, they become equal in pressure. After pressure equilibrium has been attained, the annular liquid valve 344 opens automatically, acutated by its spring. As a result, liquid flows to the inside of the container 334 through the liquid feed passageway 342 and the injection port 326, and the container is filled until the liquid surface reaches the mouth of the gas pipe 351.

Because the other valves are closed, when the liquid within the container 334 reaches the mouth at the lower surface of the gas pipe 351, the gas existing in the upper portion of the container 334 can no longer escape any more, and further filling of liquid is impossible. Hence the filled volume within the container is determined by a depth H of the lower surface of the gas pipe 351 as measured from an upper edge of the container 334, butting against the above-mentioned sealing element 338. In adjusting the amount filled, depending upon the kind of liquid and the size of the container, the above-described dimension H can be changed only by changing the level of the annular tank 332 relative to the lower support table 339 to a different setting, e.g. by using an elevator means (not shown).

The annular liquid valve 344 and the gas valve (not shown) within the gas passageway 356 are mechanically closed by a control device (not shown), and then the inner space of the container is perfectly sealed from the inner space of the annular tank 332 and the atmospheric air.

Next, the release valve 361 is opened by the tappet 360 being actuated by a cam (not shown). The pressure in the inner space of the container 334 is thus released through the passageway 363, the chamber 359, the passageway 362 and the release valve 361.

After the pressure release has been effected, when the holding cylinder 304, the sealing element 338 and the bend member 455 are raised integrally and simultaneously from the upper surface of the container by means of an elevator device (not shown), the gap space S between the upper surface of the free end portion of the bend member 455 and the middle flange **351*b* of the gas pipe 351 is gradually reduced, and eventually they butt against each other. Subsequently, the gas pipe 351 is raised higher than the upper surface of the container, joining with the movement of the aforementioned holding pipe 304. The container 334** is then transferred from a rotating zone of the filling machine to a rotating zone of a container lid fastening machine (not shown).

The spring 372 operates to normally bias the gas pipe 351 downwards. When the amount filled in the container is to be changed and adjusted, the change in the above-described gap space S, produced upon the change of the relative levels of the annular tank 332 and the lower support table 339, is equal to the compression length of the spring.

Figure 3:
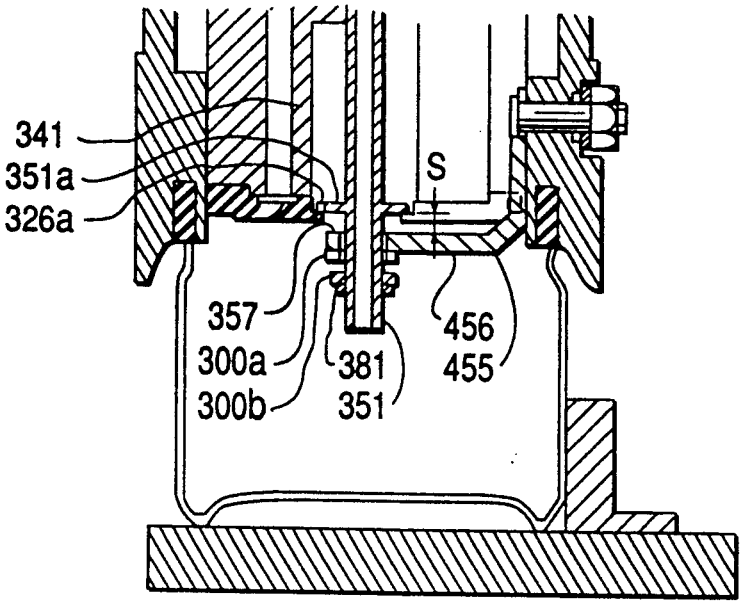
FIGS. 3 and 4 are vertical cross-sectional views of essential parts of third and fourth preferred embodiments, respectively, of the present invention.

Now, a third preferred embodiment of the present invention will be described, with reference to FIG. 3, in connection with only points different from the second preferred embodiment.

A magnet **300*a* and a magnet 300*b* are disposed with their magnetic poles opposed to each other, and hence the magnet 300*b* is normally biased downwards due to a repellant force between them. The gas pipe 351 has threads machined therearound and is thus normally biased downwards via a nut 381 corresponding to the gas pipe lower flange 351*b* in the first preferred embodiment, the nut being threadedly engaged with the lower portion of the gas pipe 351. Therefore the same effect and advantage as with the spring 372** in the first preferred embodiment can be provided.

Figure 4:
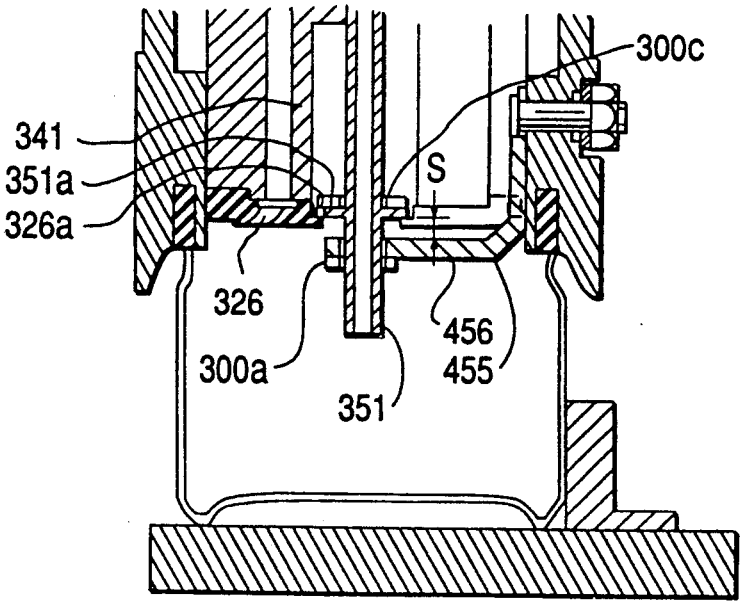

A fourth preferred embodiment is illustrated in FIG. 4. In this preferred embodiment, a magnet **300*a* and a magnet 300*c* are disposed with their opposite magnetic poles opposed to each other. The magnet 300*c* is fitted and secured to the upper surface of the middle flange 351*a* of the gas pipe 351, and the magnet 300*a* is fixedly secured to the free end portion of the bend member 455, similar to the third preferred embodiment. After the middle flange 351*a* has been stopped to descend by the step portion 326*a* of the injection port 326, the upper surface of the middle flange 351*a* is biased downwards as the magnet 300*c* is attracted towards the magnet 300*a***.

Next, a fifth preferred embodiment of the present invention will be described with reference to FIGS. 5 to 8.

Figure 5:
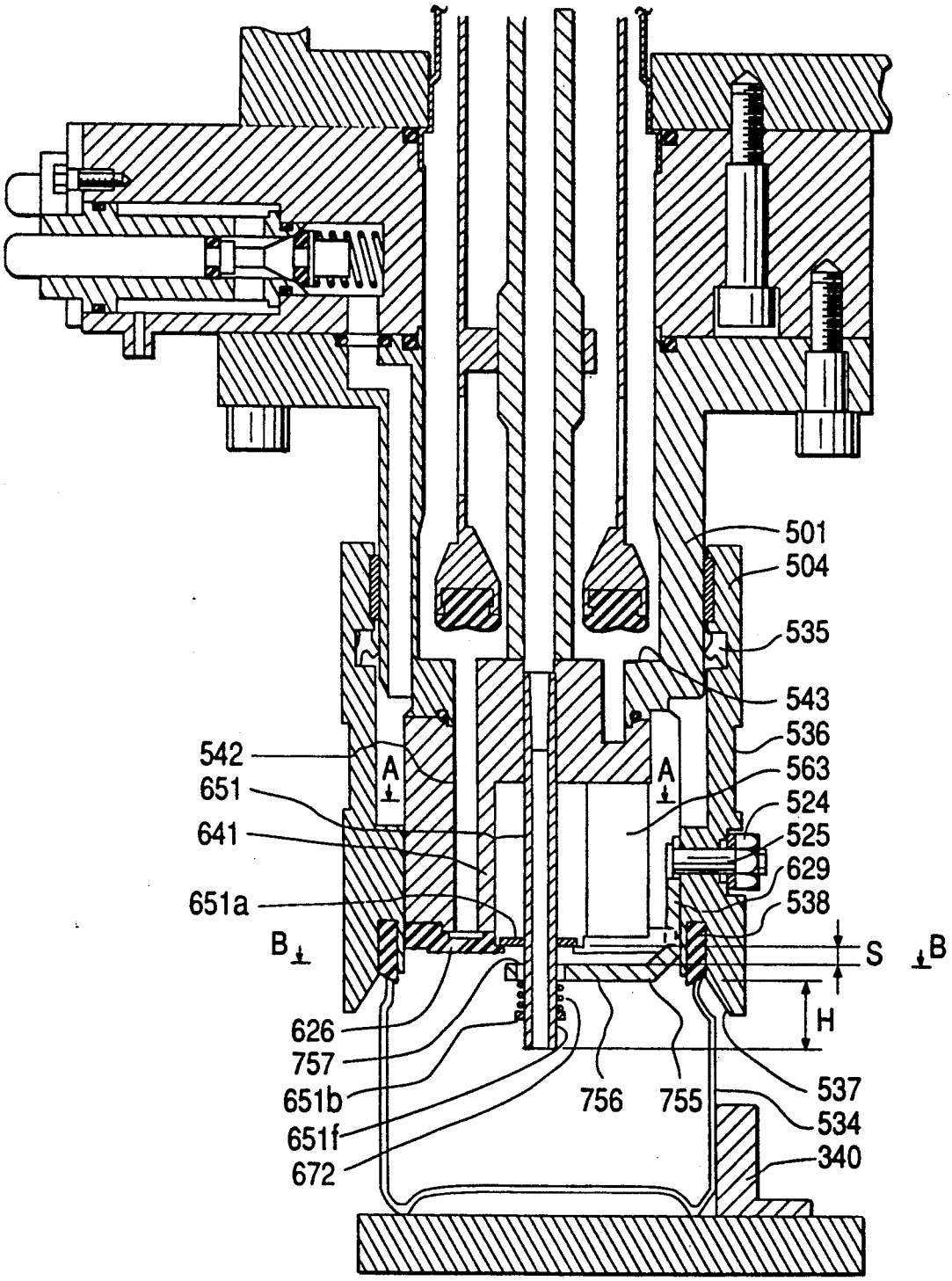
FIG. 5 is a vertical cross-sectional view of a fifth preferred embodiment of the present invention.
Figure 6:
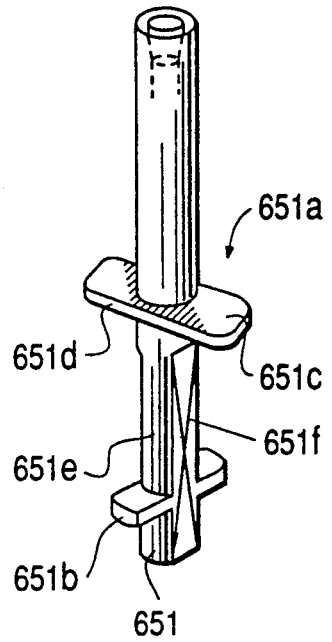
FIG. 6 is a perspective view of a gas pipe in the fifth preferred embodiment.
Figure 7:
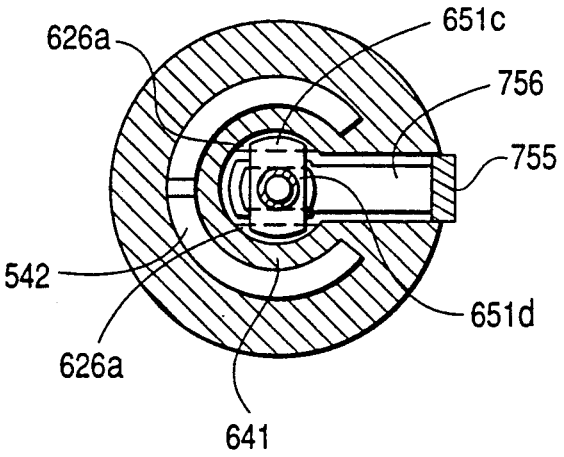
FIG. 7 is a horizontal cross-sectional view of the same preferred embodiment taken along line A—A in FIG. 5.
Figure 8:
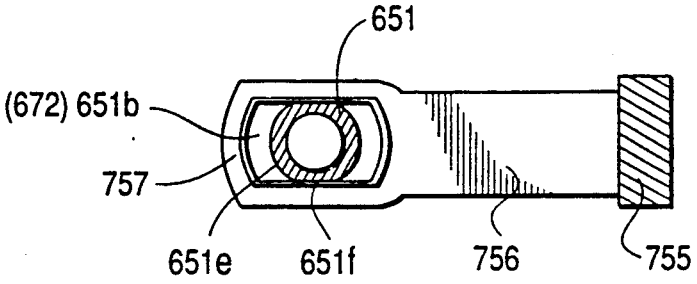
FIG. 8 is another horizontal cross-sectional view of the same preferred embodiment taken along line B—B in FIG. 5.
Figure 9:
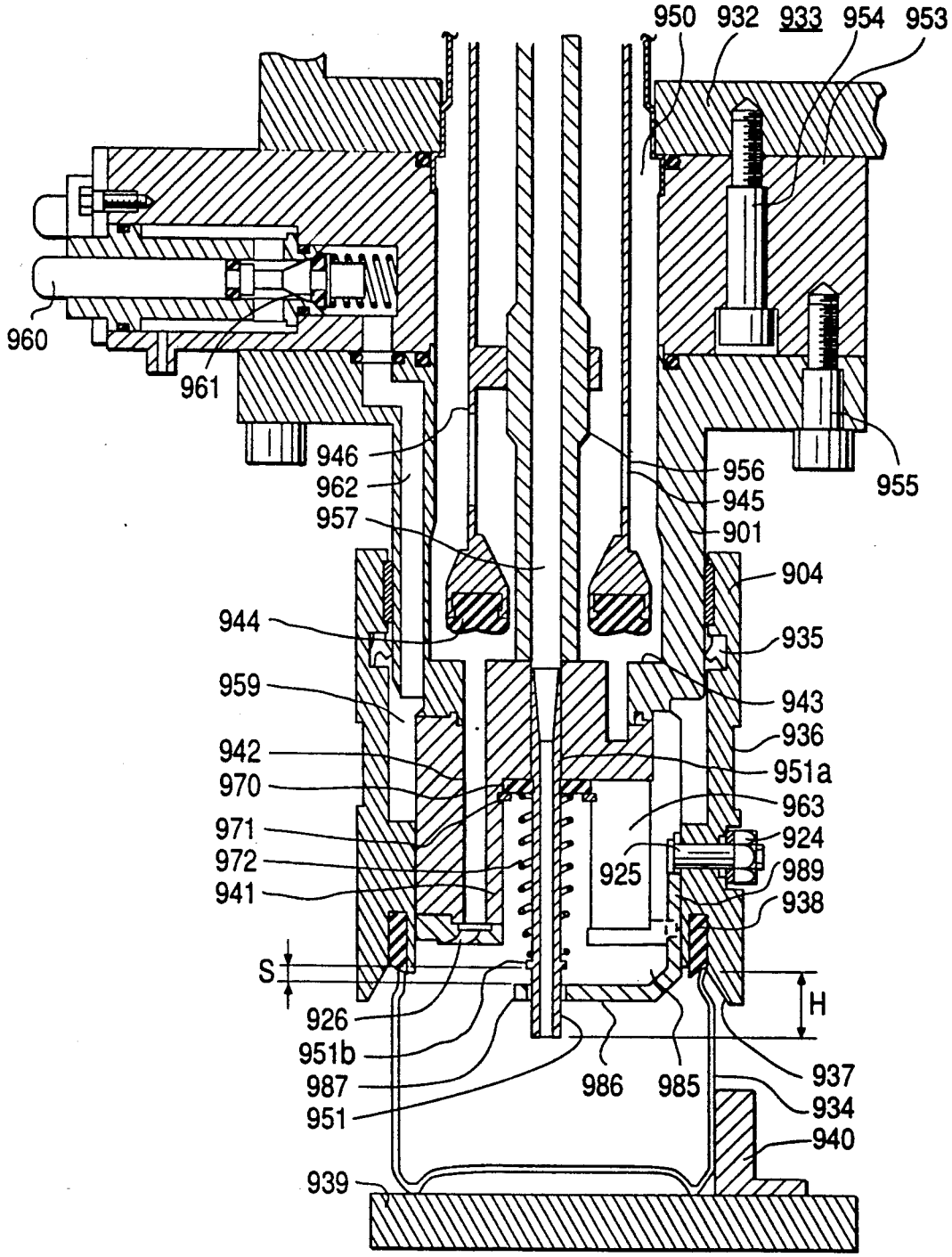
FIG. 9 PRIOR ART
FIG. 9 is a vertical cross-sectional view of one example of a filling apparatus in the prior art.

FIG. 6 is a perspective view of a gas pipe, FIG. 7 is a cross-sectional view taken along line A—A in FIG. 5, and FIG. 8 is a cross-sectional view taken along line B—B in FIG. 5. On the outside of a housing 501 is slidably mounted a holding cylinder 504, which is formed as a hollow cylinder and serves to position and seal a container 534. The holding cylinder 504 is held in tight contact with the outer surface of the housing 501 at a location indicated by reference numeral 535. At a central side surface portion of the holding cylinder 504 is a recess 536 engageable with a fork-shaped tool (not shown) for vertically moving the holding cylinder 504. The holding cylinder 504 has a positioning conical portion 537 formed with a tapered surface extending inwardly from its bottom end. At the inner end portion of the positioning conical portion 537 is disposed a sealing element 538 serving as a seal member for the container 534.

The housing 501 has an inner piece 641. Between the inner piece 641 and the housing 501 is formed a nearly annular liquid feed passageway 542. At the bottom of the liquid feed passageway 542 is provided an injection port 626. A liquid jet flows toward an inner wall surface of the container 534, where the liquid flows down towards the bottom of the container while forming a laminar flow as much as is possible. The housing 501 has an inside step 543 which serves as an upper limit for the inner piece 641.

On the inside of the inner piece 641 is disposed a gas pipe 651. At the middle portion of the gas pipe 651 is provided a gas pipe middle flange 651*a*, the flange 651*a* having a gas pipe longer diameter flange portion 651*c* and a gas pipe shorter diameter flange portion 651*d* on opposed side surfaces orthogonal to each other.

Within the injection port 626, which is fixedly secured to the housing 501 together with the above-mentioned inner piece 641, is provided a step 626*a* having a slot-shaped opening which has a width narrower than the length of the gas pipe longer diameter flange 651*c* and broader than the length of the gas pipe shorter diameter flange 651*d* (see FIG. 7, it is to be noted that in FIG. 5, for convenience of explanation, the gas pipe longer diameter flange 651*c* and the step 626*a* are illustrated as directed in the same direction as the gas pipe lower flange 651*b*). The step 626*a* serves to position the gas pipe 651 in the downward direction. Under the middle flange 651*a* of the gas pipe 651 and the outside of the gas pipe 651 is disposed a spring 672. The bottom end of the spring 672 is fitted and secured to an upper surface of the gas pipe lower flange 651*b*, while its top end butts against a lower surface of a free end portion 756 of a bend member 755 fixedly secured to the holding cylinder 504, whereby the gas pipe 651 is normally biased downwards with respect to the injection port 626 fixedly secured to the housing 501.

The free end portion 756 of the bend member 755 slidably fits around the outer circumference of the gas pipe 651 under the middle flange. The bend member 755 has another arm 629 thereof connected to the holding cylinder 504 by means of a pin 525 and a nut 524. When the sealing element 538 butts against the top edge of the container 534 as described above, after the gas pipe 651 has been stopped at a fixed position with the middle flange 651*a* butting against the step 626*a* at the inner circumferential portion of the injection port, the free end portion 756 of the bend member 755 descends further while compressing the spring 672. A gap space S is thus produced between the lower surface of the gas pipe middle flange 651*a* and the upper surface 757 of the free end portion 756 of the bend member 755, and sealing between the filling apparatus and the upper edge of the container becomes possible.

On the outer circumferential surface of the gas pipe 651 under the gas pipe middle flange 651*a* are provided guide surfaces 651*f* recessed from the gas pipe outer circumferential surface 651*e* and directed in the axial direction of the gas pipe. The free end portion 756 of the bend member 755 fixedly secured to the holding cylinder 504 is slidably fitted to the guide surfaces 651*f* provided at the lower portion of the gas pipe 651 (see FIG. 8).

Owing to the above-mentioned provision, the gas pipe 651 is inhibited from rotation. Thus the phase relationship between the gas pipe longer diameter flange 651*c* and the step 626*a* provided at the inner circumferential portion of the injection port is not variable and prevention of the gas pipe 651 from slipping downwardly out can be insured.

On the other hand, when the gas pipe 651 is to be replaced, if the holding cylinder 504 is extracted downwards, the fitting engagement between the gas pipe 651 and the free end portion 756 of the bend member 755 is released. Therefore when the gas pipe 651 is rotated by 90½, as the position of the gas pipe longer diameter flange 651*c* comes to the position in the lengthwise direction of the slot-shaped opening formed at the step 626*a* provided at the inner circumferential portion of the injection port, the gas pipe 651 can be easily removed without using a tool.

As will be apparent from the above description, according to the present invention, the spring for normally biasing the gas pipe downward does not directly butt against the housing of the filling apparatus. When a container is removed from the filling apparatus, the stroke of raising the holding member upward does not propagate to the spring. Further, with the compression length of the spring, only an adjustment width S (normally S being small as compared to the stroke of the holding member) for changing and adjusting the filled amount is necessary. Thus there is no need to insure a space for mounting the spring within the filling nozzle, as is the case with the apparatus in the prior art. It becomes possible to employ the apparatus as a filling apparatus adapted for a container having a small mouth diameter, which was difficult in the case of the apparatus in the prior art.

In addition, owing to the fact that the spring is disposed along the inner circumference of the holding member, by avoiding the space on the inner circumferential side of the housing inner space, which is positioned right above the mouth edge portion of the container, the invention provides the advantage that accidents, such as mixing of foreign matters into a container caused by breaking and dropping of a spring or a retainer ring due to unexpected trouble, can be avoided.

Also, according to the present invention, the liquid filling apparatus includes a housing, an annular liquid feed passageway disposed within the housing, an annular liquid valve for opening and closing the liquid feed passageway, a holding member having a positioning conical portion and a sealing element for a container to be filled with liquid and disposed slidably along the housing, a gas pipe for introducing gas into the container and discharging gas from the container, and a bend member fixedly secured to the holding member to hold the gas pipe in a vertically movable manner with respect to the holding member. The gas pipe slidably fits in an inner space of the housing, a free end portion of the bend member fixedly secured to the holding member slidably fits between a middle flange and a lower flange provided on the gas pipe, a member for normally biasing the gas pipe downwardly is provided between a lower surface of the free end portion of the bend member and the lower flange of the gas pipe, and the position in the downward direction of the gas pipe is limited by a step provided at the bottom portion of the housing inner piece and the middle flange of the gas pipe, whereby a predetermined gap space is provided between the middle flange of the gas pipe and the upper surface of the free end portion of the bend member. The following advantages are obtained:

1 Since the spring normally biasing the gas pipe downward is not directly butting against the housing of the filling apparatus, cleaning is easy. 2 When a container is removed from the filling apparatus, a stroke of raising the holding member does not propagate to the above-mentioned spring. 3 With the compression length of the spring, only an adjustment width S (normally S being small as compared to a stroke of a holding member) for changing and adjusting the amount filled is necessary.

From the above-mentioned reasons 1–3, there is no need to insure a space for mounting the spring within the filling nozzle, as is the case with the apparatus in the prior art, and therefore, it becomes possible to employ the apparatus as a filling apparatus adapted for a container having a small mouth diameter, which was difficult in the case of the apparatus in the prior art.

In addition, upon cleaning the filling apparatus, since the above-described spring has fewer turns than the apparatus in the prior art, the cleaning effect during the cleaning process becomes high.

Also, in the case of the magnets used in the third and fourth preferred embodiments, the cleaning effect is further enhanced.

Furthermore, according to the present invention, upon replacement of the gas pipe, if the holding member is extracted downwards and the fitting engagement between the gas pipe and the bend member is released, then the gas pipe can be dismounted by only manually rotating the gas pipe by 90½.

Accordingly, it has become possible to perform replacement work easily and within a short period of time as compared with the apparatus in the prior art, and without using a special tool.

While a principle of the present invention has been described above in connection to preferred embodiments of the invention, it is intended that all matter contained in the above description and shown in the accompanying drawings shall be interpreted to be illustrative, and not in a limiting sense.

What is claimed is:

1. A liquid filling apparatus, comprising:

a housing having an inner housing piece;

means defining an annular liquid feed passageway within said housing;

a valve in said housing for opening and closing said liquid feed passageway;

a holding member slidably disposed on said housing, said holding member having an inner circumferential surface;

a positioning conical cylinder fixed to said holding member having a conical positioning portion for positioning a container to be filled with liquid and a sealing element for sealing the container;

a gas pipe for introducing gas into and discharging gas from the container, said gas pipe being slidably fitted in said inner housing piece, said inner housing piece having a positioning member thereon for positioning said gas pipe;

a circular ring slidably disposed along said inner circumferential surface of said holding member;

a spring disposed along said inner circumferential surface of said holding member for downwardly biasing said circular ring; and a bend member fitted around the outer circumferential surface of said gas pipe and fixed to said circular ring;

wherein a desired gap space is provided between a lower surface of said circular ring and an upper surface of said positioning conical cylinder fixed to said holding member.

2. The liquid filling apparatus of claim 1, wherein said gas pipe has a flange thereon and said positioning member comprises a step engaging said flange.

3. A liquid filling apparatus comprising:

a housing having an inner housing piece;

means defining an annular liquid feed passageway within said housing;

an annular valve in said housing for opening and closing said liquid feed passageway;

a holding member slidably disposed on said housing, said holding member having a conical positioning portion for positioning a container to be filled with liquid and a sealing element for sealing the container;

a gas pipe for introducing gas into and discharging gas from the container, said gas pipe being slidably fitted in said inner housing piece, and said gas pipe having a lower flange thereon at a lower portion thereof and a middle flange thereon at a central portion thereof;

a bend member fixedly secured to said holding member for holding said gas pipe such that said gas pipe can be vertically moved with said holding member, said bend member having a free end portion slidably engaged on said gas pipe between said middle flange and said lower flange;

a biasing arrangement for downwardly biasing said gas pipe provided between said free end portion of said bend member and one of said flanges on said gas pipe; and a positioning step at a bottom portion of said inner housing piece for positioning said gas pipe by limiting the downward movement of said middle flange of said gas pipe;

wherein a predetermined gap space is provided between said middle flange of said gas pipe and an upper surface of said free end portion of said bend member.

4. The liquid filling apparatus of claim 2, wherein said biasing arrangement comprises a spring between said free end portion of said bend member and said lower flange.

5. The liquid filling apparatus of claim 2, wherein said biasing arrangement comprises a first magnet on said free end portion of said bend member and a second magnet on said lower flange.

6. The liquid filling apparatus of claim 2, wherein said biasing arrangement comprises a first magnet on said free end portion of said bend member and a second magnet on said middle flange.

7. A liquid filling apparatus, comprising:

a housing;

means defining an annular liquid passageway within said housing;

an annular valve in said housing for opening and closing said liquid feed passageway;

a holding member slidably disposed on said housing, said holding member having a conical positioning portion for positioning a container to be filled with liquid and a sealing element for sealing the container;

a gas pipe for introducing gas into and discharging gas from the container, said gas pipe having a lower flange thereon at a lower portion thereof and a middle flange thereon at a central portion thereof;

said means defining said liquid passageway having a step at a lower portion thereof for engaging and limiting the downward movement of said middle flange of said gas pipe and supporting said gas pipe;

a bend member mounted to said holding member and holding said gas pipe between said middle and said lower flanges such that said gas pipe can be vertically moved with said holding member; and a spring disposed between said bend member and said lower flange of said gas pipe for downwardly biasing said gas pipe;

wherein said middle flange on said gas pipe has a longer diameter and a shorter diameter in orthogonal directions, said step for supporting said middle flange has a slot-shaped opening having a width narrower than said longer diameter and wider than said shorter diameter, and said gas pipe has a guide surface at a lower end portion thereof engaging with said bend member to inhibit rotation of said gas pipe, whereby said gas pipe can be dismounted by lowering said bend member off of said gas pipe and rotating said gas pipe by 90°.

* * * * *